US006398145B1

(12) United States Patent
Yang

(10) Patent No.: US 6,398,145 B1
(45) Date of Patent: Jun. 4, 2002

(54) MEASURING TAPE CORE

(75) Inventor: Tse-Chung Yang, Maio Li Hsien (TW)

(73) Assignee: Taiwan Woei Shing Co., Ltd., Maio Li Hsien (TW)

( * ) Notice: Subject to any disclaimer, the term of this patent is extended or adjusted under 35 U.S.C. 154(b) by 0 days.

(21) Appl. No.: 09/678,114

(22) Filed: Oct. 2, 2000

(51) Int. Cl.[7] ..... B65H 75/48
(52) U.S. Cl. ..... 242/375; 242/379.1
(58) Field of Search ..... 242/375, 379, 242/379.1, 379.2, 600, 602, 607, 613, 125, 125.1; 33/755, 761, 769, 770

(56) References Cited

U.S. PATENT DOCUMENTS 1,320,767 A * 11/1919 Komorous ..... 242/379 X
3,443,316 A * 5/1969 Edgell ..... 242/379 X
3,450,367 A * 6/1969 Edgell ..... 242/379 X
3,686,767 A * 8/1972 Duda et al. ..... 33/769
4,142,693 A * 3/1979 Czerwinski ..... 33/769
4,972,601 A * 11/1990 Bickford et al. ..... 33/770
5,683,054 A * 11/1997 Chen ..... 242/379 X

* cited by examiner

*Primary Examiner*—William A. Rivera
(74) *Attorney, Agent, or Firm*—Pro-Techtor International Services

(57) ABSTRACT

A measuring tape core has a support (23), an opening (22) defined underneath and adjacent the support (23), an I-shaped opening (24) in communication with the opening (22) and two regulators (21) each oppositely formed adjacent to the opening (22) and on top of the I-shaped opening (24), such that when the coiled spring extends out from the core, the force applied on the coiled spring will not break the coiled spring easily.

1 Claim, 2 Drawing Sheets

MEASURING TAPE CORE

BACKGROUND OF THE INVENTION

1. Field of the Invention

The present invention relates to a measuring tape core, and more particularly to a core received in a housing of the measuring tape and having a structure so configured that the tape will not easily break after repetitive usage.

2. Prior Art Description

With reference to FIGS. 3 and 4, a conventional core (100) of a measuring tape has a coiled spring (200) extendably wound around the core (100). A distal end of the coiled spring (200) is securely connected with a tape (300). With the elasticity of the coiled spring (200), the tape (300) is thus able to be received in the housing (not numbered) of the measuring tape. However, when the coiled spring (200) extends out from the core (100), the coiled spring (200) passes through an I-shaped opening (101) in the core (100). The neck (202) of the coiled spring (200) passes through a sharp edge (102) of the core (100). After the coiled spring (200) passes through the I-shaped opening (101), it bends upward with respect to the core (100). A point (201) close to the end of the neck (202) is quite easily broken after repetitive extension of the tape (300) as well as the coiled spring (200). Because the coiled spring (200) is the heart of the measuring tape, when the coiled spring (200) breaks, the user will have to buy another measuring tape, which is quite troublesome and too time consuming.

The present invention provides an improved core of the measuring tape to overcome the above mentioned shortcomings.

SUMMARY OF THE INVENTION

The primary objective of the invention is to provide an improved measuring tape core to extend the life span of the coiled spring.

To accomplish the aforementioned purpose, the core of the measuring tape of the invention has a support mounted on top of an opening and two regulators each oppositely formed on the mouth of the opening, such that when the coiled spring extends out from the opening, the coiled spring first passes over the support and then extends out underneath the two opposed regulators. With this arrangement, there is no breaking point formed on the neck of the coiled spring, which prevents the coiled spring from being broken due to repetitive usage of the tape.

Other objects, advantages and novel features of the invention will become more apparent from the following detailed description when taken in conjunction with the accompanying drawings.

DETAILED DESCRIPTION TO THE PREFERRED EMBODIMENT

Figure 1:
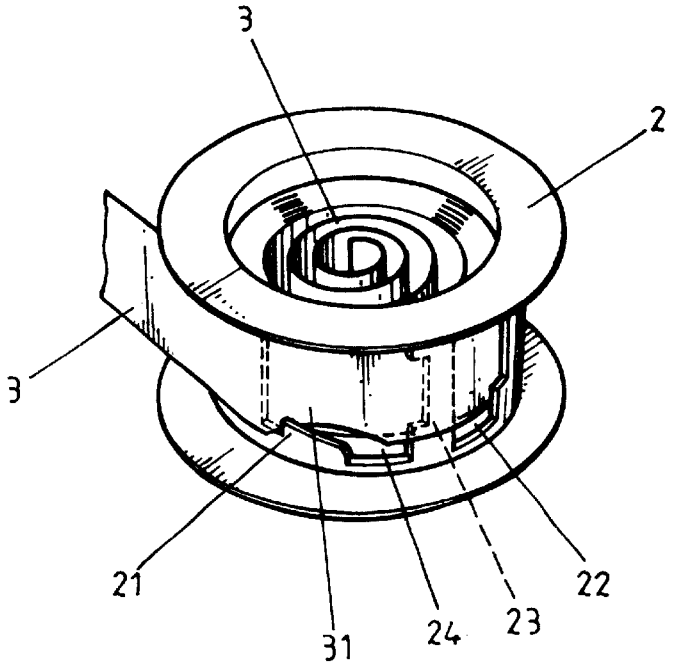
FIG. 1 is a perspective view of the measuring tape core constructed in accordance with the present invention.
Figure 2:
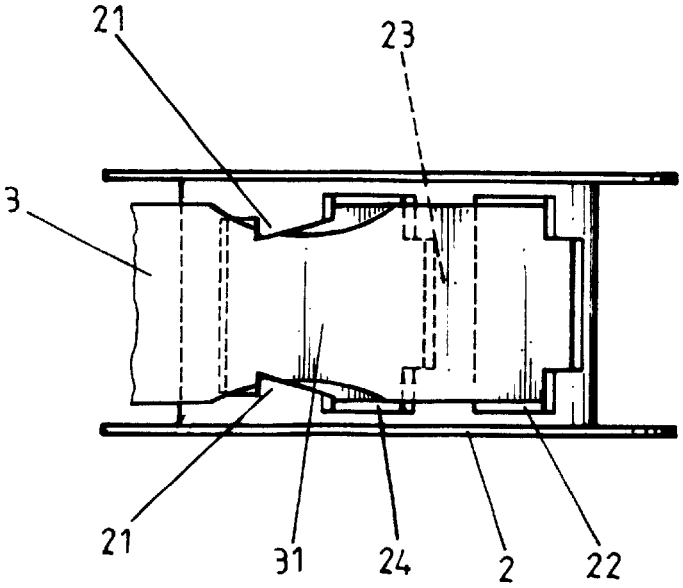
FIG. 2 is a top plan view showing the extension of the coiled spring from the core.
Figure 3:
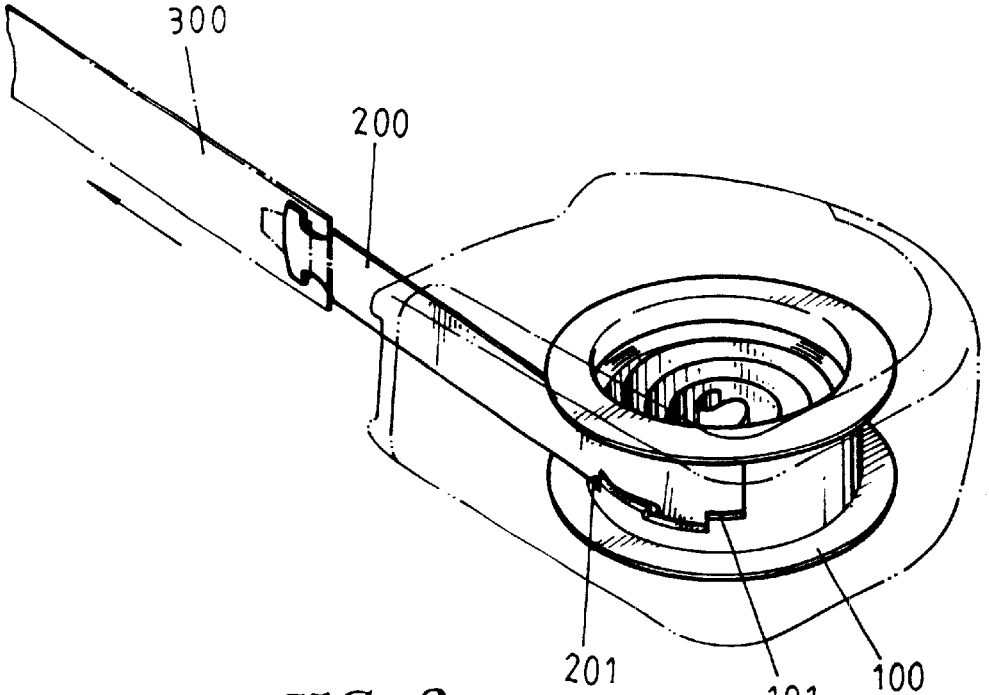
FIG. 3 (PRIOR ART)
FIG. 3 is a perspective view of a conventional measuring tape core with the coiled spring wound around the core.
Figure 4:
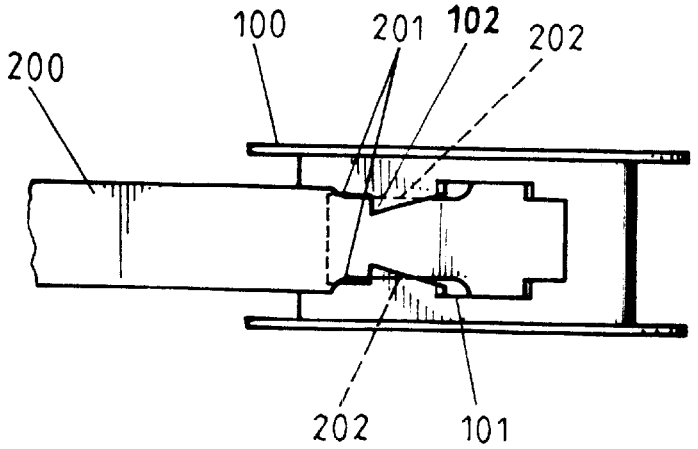
FIG. 4 (PRIOR ART)
FIG. 4 is a top plan view of the core of FIG. 3, wherein a breaking point is caused by the design of the opening in the core.

With reference to FIGS. 1, and 2, a measuring tape core (2) in accordance with the present invention has a support (23), an opening (22) defined underneath the support (23), an I-shaped opening (24) in communication with the opening (22) and two regulators (21) each oppositely formed close to the opening (22) and on top of the I-shaped opening (24).

When a coiled spring (3) provided with a neck (31) extends out from the core (2) of the invention, the neck (31) first passes over the support (23) and then extends out the core (2) from the I-shaped opening (24) and beneath the two opposed regulators (21). With this arrangement, the force applied to the coiled spring (3) is minimized and there will be no breaking point caused on the neck (31) of the coiled spring.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. The measuring tape core comprising:

a support, an opening defined underneath and adjacent the support, an I-shaped opening in communication with the opening and two regulators each oppositely formed adjacent to the opening and on top of the I-shaped opening;

wherein the core is so configured that when a coiled spring of the measuring tape extends out from the core, the coiled spring first passes through the opening and over the support and then extends through the I-shaped opening from beneath the two opposed regulators, such that the force applied to the coiled spring is minimized.

* * * * *